US005279495A

United States Patent [19]

Rello

[11] Patent Number: 5,279,495

[45] Date of Patent: Jan. 18, 1994

[54] PHASE ADJUSTMENT APPARATUS FOR INSERTION MACHINE

[75] Inventor: Robert M. Rello, Slatington, Pa.

[73] Assignee: Bell & Howell Phillipsburg Company, Allentown, Pa.

[21] Appl. No.: 977,466

[22] Filed: Nov. 17, 1992

[51] Int. Cl.[5] ..... B65H 39/02; B65H 29/20

[52] U.S. Cl. ..... 270/54; 270/58; 271/187; 271/315; 198/576

[58] Field of Search ..... 270/45, 54, 55, 58; 271/187X, 315X, 315; 198/576, 575; 53/50

[56] References Cited

U.S. PATENT DOCUMENTS

| | | | |
|---|---|---|---|
| 1,265,663 | 5/1918 | Huguelet | 493/243 |
| 3,809,385 | 5/1974 | Rana . | |
| 3,825,247 | 7/1974 | Fernandez-Rana et al. | 270/58 |
| 4,241,907 | 12/1980 | McCain et al. | 270/54 |
| 4,511,130 | 4/1985 | Barton et al. . | |
| 4,625,952 | 12/1986 | Schniter . | |
| 4,789,147 | 12/1988 | Berger et al. . | |
| 4,813,662 | 3/1989 | Merwarth et al. | 271/187 X |
| 4,826,149 | 5/1989 | Tucker . | |
| 4,881,731 | 11/1989 | Simpson-Davis | 271/315 |

*Primary Examiner*—Edward K. Look
*Assistant Examiner*—John Ryznic

[57] ABSTRACT

A mail insertion machine (10) having an elongated insert track (12) with one or more insert dispensing devices (16) with rotary insert feeding mechanisms (22) for depositing inserts at longitudinally-space movable driving members (14) on the insert track includes a power train interconnected between the driving members and each insert dispensing device for driving them in a predetermined phase relationship with a phase-adjustment mechanism for adjusting the phase relationship. The phase-adjustment mechanism includes first and second power transmitting elements (28, 30) which can be selectively engaged with and disengaged from one another by an engaging mechanism (38), an electronic sensing and indicating mechanism mounted on the first and second power transmitting elements for sensing their positions relative to one another and providing an electronic phase-indication signal indicative thereof, and a phase-adjustment mechanism (54, 60, 64) coupled to the power train for acting on the power train when the first and second power transmitting elements are disengaged to achieve a desired phase-indication signal from the electronic sensing and indicating mechanism. In one embodiment, phase adjustment is accomplished by an electric motor which is automatically adjusted by a control system responding to the phase-indication signal and input instructions.

19 Claims, 1 Drawing Sheet

PHASE ADJUSTMENT APPARATUS FOR INSERTION MACHINE

BACKGROUND OF THE INVENTION

This invention relates generally to the art of mail inserting machines, that is machines for preparing groups of inserts to be inserted into envelopes of the like.

Envelope inserting machines often include insert tracks along which pusher pins move to drive groups, or piles, of inserts which are sequentially deposited thereon by gripper jaws of insert rotors, or the like. That is, there are often a plurality of insert dispensing devices having rotors spaced along an insert track, each depositing a different insert in front of each pair of pusher pins, thereby creating a pile of inserts in front of each pair of pusher pins which is eventually inserted into an envelope. Because such mail insertion machines are often used with different size inserts, it is often necessary to change phase relationships, or synchronization, between various ones of the insert dispensing devices and the pairs of pusher pins on the insert track. In this regard, spacings between insert track pusher pin pairs are normally fixed as is an angular distance between gripper jaws on insert rotors of the insert dispensing devices. However, it is normally desirable that each insert dispensing device deposits its insert on the insert track immediately in front of a pusher pin pair. If it deposits an insert too far in front of a pusher pin pair, the insert will not be on the insert pile of the pusher pin pair which makes it difficult to insert the pile into an envelope. Also, inserts which are too far in front of pusher pin pairs, are not quickly brought into registration by pusher pin pairs and can thereby improperly rotate and possibly jam the insert track. On the other hand, if an insert dispensing device deposits an insert on top of a pusher pin pair so that the pusher pin pair does not contact edges of the insert to control it and bring it into registration with other inserts of a pile, this could also jam up the insert track and/or cause inserts to get into incorrect piles.

Normally, gripper jaws of insert rotors grip leading edges of inserts for depositing them onto the insert track. Thus, if an insert dispensing device is depositing inserts six inches wide onto the insert track, it will be synchronized to release leading edges of the inserts slightly more than six inches from pusher pin pairs on the insert track in order to deposit the inserts immediately in front of the pusher pin pairs. It will be appreciated that if an insert dispensing device at an insert station, which has been depositing six-inch inserts, is required to deposit three-inch inserts, the phase relationship of the insert rotor gripper jaws to the insert track pusher pins must be changed so that the gripper jaws release leading edges of inserts slightly more than three inches in front of pusher pin pairs. Such synchronization has been accomplished in the past manually. That is, there is power linkage, or a power train, between rotation motion of the insert rotors at the insert dispensing devices and linear movement of the pusher pins along the insert track. Phasing has normally been accomplished by manually releasing a clamp in this power train, or linkage, so as to allow manual rotation of insert rotors independently of pusher pin movement on the insert track. Each insert rotor is then rotated independently until a proper synchronization between the pusher pin movement and the insert-rotor, gripper-jaw movement is achieved. The clamp is then again tightened. The machine is then test run, with further manual adjustments being made as required. As can be imagined, such adjustments are quite time consuming and must be made for each insert dispensing device.

Thus, it is an object of this invention to provide a phase-adjustment device for an insert machine which can be opereated remotely, automatically, and/or in a programmed manner, to adjust phase relationships between movements of insert dispensing devices and driving members of an insert track.

It is also an object of this invention to provide such a phase-adjustment device which is relatively uncomplicated and relatively inexpensive to construct.

SUMMARY OF THE INVENTION

According to principles of this invention, a phase-adjustment mechanism for adjusting a phase relationship between movement of insert dispensing devices and driving members of an insert track includes an electronically activated engagement mechanism for selectively engaging and disengaging first and second power transmitting elements of a power train between the insert track and the insert dispensing device, an electronic sensing and indicating mechanism mounted on the first and second power transmitting elements for sensing their positions relative to one another and providing an electronic phase-indication signal indicative thereof, and a phase-adjustment mechanism coupled to the power train for acting on the power train when said first and second power transmitting elements are disengaged to achieve a desired phase-indication signal from the electronic sensing and indicating mechanism. In a preferred embodiment, the engagement mechanism can be actuated electronically. The insert dispensing device comprises an insert rotor with gripper jaws thereon, and the phase-adjustment mechanism is an electronically operated motor. Further, in a preferred embodiment, a logic control system is electrically interconnected between the electronic sensing and indicating mechanism and the electronic motor for automatically achieving a phase relationship in accordance with input instructions to the control system. In one embodiment the electronic sensing and indicating mechanism is an electronic graduation slide mechanism interconnected between the first and second power transmitting elements.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 2:
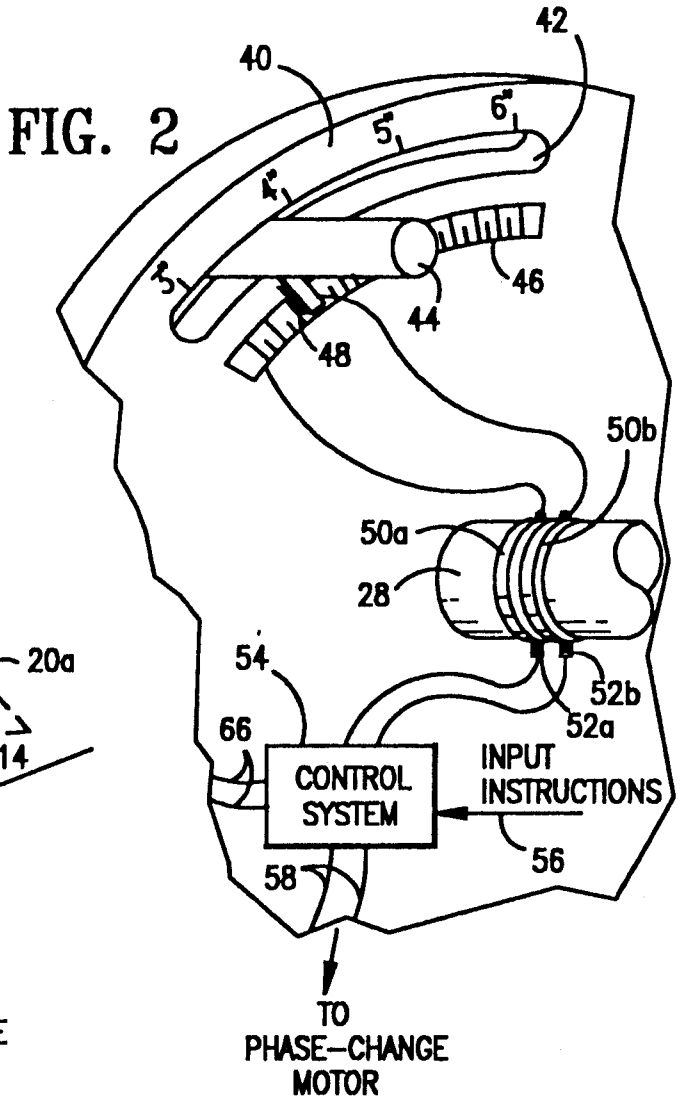
FIG. 2 is a fragmented enlarged isometric, partially schematic, view of a portion of the mail insertion machine of FIG. 1.

A mail insertion machine 10 comprises an elongated insert track 12 having longitudinally-spaced, movable, driving members, in the form of pusher pin pairs 14, thereon, a plurality of insert dispensing devices 16 (only one shown) and a power train, or linkage, between the pusher pin pairs 14 and the insert dispensing device 16 which includes a phase-adjustment mechanism of this invention.

The pusher pin pairs 14 are normally attached to chains or belts and spacings therebetween normally are not adjustable. The pusher pin pairs normally move at a uniform speed in a direction indicated by an arrow 18 to push against following edges of inserts 20 to not only drive the inserts 20 but to also register them and to control them.

In a preferred embodiment of this invention, the insert dispensing device 16 comprises an insert rotor 22, having feeding mechanisms comprised of gripper jaw pairs 24 thereon, for sequentially gripping leading edges 26 of inserts in an insert hopper (not shown), and rotating to pull each insert from the hopper, further rotating to position the insert with its following edge 19 immediately adjacent a following pusher pin pair 14, but yet in front of the following pusher pin pair 14. The gripper jaw pair 24 then releases the leading edge 26 of the insert and allows the following pusher pin pair 14 to engage the insert for further driving it along the insert track 12 in the direction of the arrow 18. As can be understood, if this gripper jaw action of the insert dispensing devices 16 is properly synchronized, or phase related, with movement of the pusher pin pairs, inserts sequentially deposited in front of pusher pin pairs 14 by insert dispensing devices 16 at insert stations will form piles of inserts in front of the pusher pin pairs 14. It will also be understood that if these members are not properly synchronized, or phase related, subsequent inserts **20*b* could be dropped too far in front of previously deposited inserts 20*a* or on top of pin pairs 14**, neither of which is desirable for obvious reasons and as is set forth above.

In order to maintain movement of the pusher pin pairs 14 in a proper phase relationship with rotation of the insert rotor 22, a power linkage, or train, is provided between these two members via a timed drive shaft 28, a timing pulley 30 which is coupled to the timed drive shaft 28, a belt 32, an insert rotor pulley 34, and an insert-rotor shaft 36. Under normal operations, all of these members are engaged with one another to move together so that a timed relationship is maintained between movement of the pusher pin pairs 14 and the gripper jaw pair 24. In this regard, the gripper jaw pairs 24 are spaced the same distance from one another as are the pusher pin pairs.

According to this invention, this power train includes a phase-adjustment mechanism for adjusting this phase relationship between the pusher pin pairs 14 and the gripper-jaw pairs 24. This phase-adjustment mechanism includes a conventional electrically-actuated clutch, or brake, 38 which selectively allows engagement or disengagement between the timing pulley 30 and the timed drive shaft 28. In this regard, a shaft disk 40 which is rigidly affixed to the timed drive shaft 28, has an arc-shaped slot 42 therein through which a limit pin 44, which is rigidly affixed to the timing pulley 30, extends. When the clutch 38 is disengaged, so that the timing pulley 30 can rotate independently of the time drive shaft 28, the limit pin 44 limits the amount of movement between the timing pulley 30 and the timed drive shaft 28 to the length of the slot.

As can be seen in more detail in FIG. 2, mounted on the shaft disk 40 is a graduated electrical impedance indicator strip 46 which is contacted by an indicator brush, or slide, 48 which is affixed to the limit pin 44. In a preferred embodiment, the graduated electrical impedance strip 46 is a rheostat, however, it will be understood by those skilled in the art that many other types of electrical measuring mechanisms could also be used such as capacitive, inductive, and/or magnetic devices.

The timed drive shaft 28 has a pair of slip rings **50*a* and *b* thereon which are respectively slidably engaged to brushes 52*a* and *b* which are coupled to an electronic logic control system 54. Also, one end of the graduated electrical impedance strip 46 is attached to one of the slip rings 50*a* while the brush 48 is attached to the other slip ring 50*b*, which is shown schematically in the drawings. In this respect, these electrical attachments are made such that they do not get in the way of the slip rings 50 sliding on the brushes 52, although this does not appear to be the case in FIG. 2** where the drawings are arranged for ease of understanding.

By applying a voltage across the brush pair **52*a* and *b*, the control system 54 can measure the relative position of the indicator brush 48 on the graduated electrical impedance strip 46 and thereby measure the respective phase relationship between the timing pulley 30 and the shaft disk 40. The control system receives input instructions at 56 and is coupled via lines 58 to a DC phase change motor 60 and via lines 66 to the clutch 38. The phase-change motor 60 rotates a small gear 62 which in turn rotates a phase change gear 64 which is rigidly coupled to the insert-rotor shaft 36**.

Figure 1:
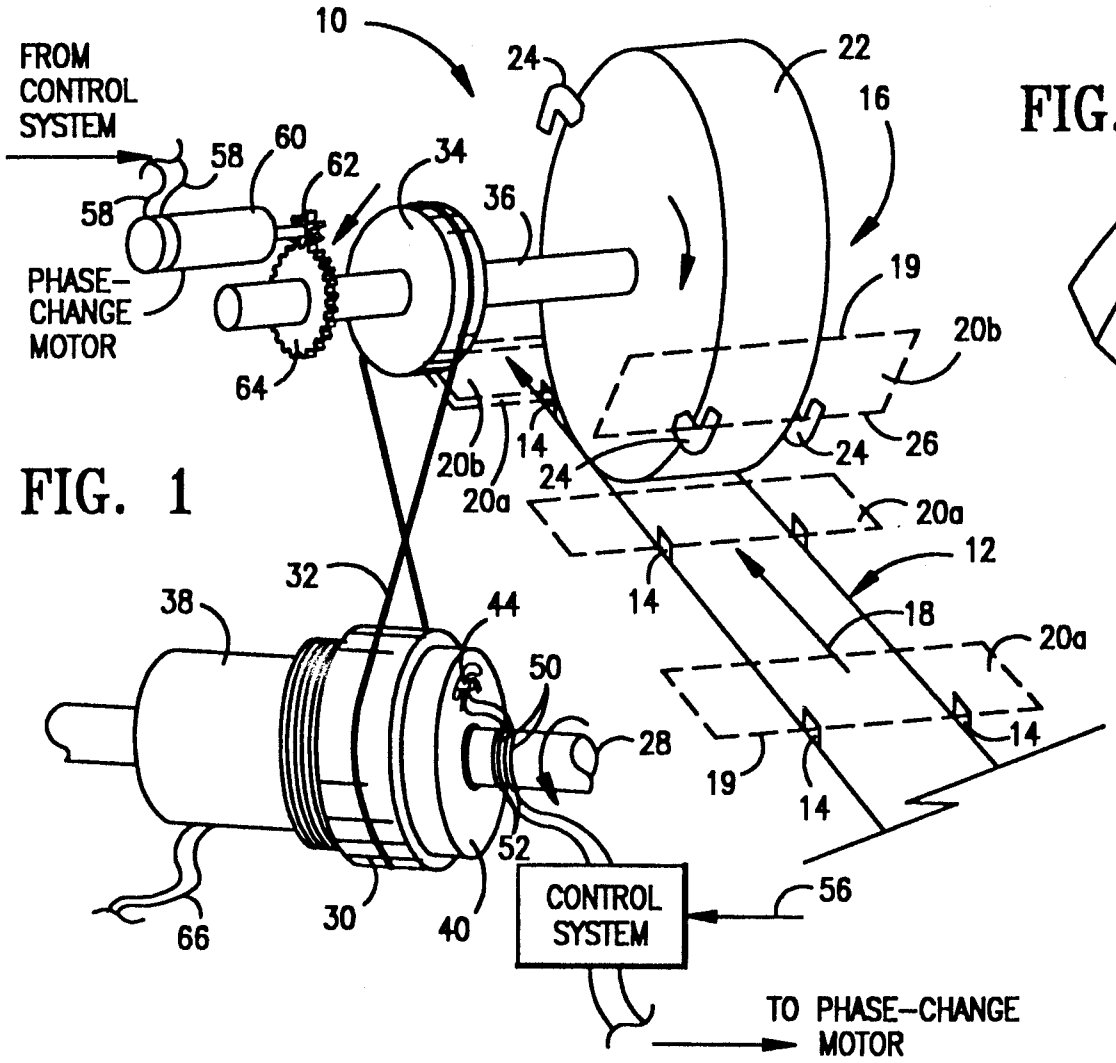
FIG. 1 is a fragmented, partially schematic, isometric view of a portion of a mail insertion machine employing a phase-adjustment apparatus of this invention.

Looking now at operation of the insertion machine 10 shown in FIGS. 1 and 2, it is assumed first that each insert dispensing device 16, that is, each insert rotor 22, and its respective gripper-jaw pair 24, deposits inserts **20*b* on top of insert piles 20*a* directly in front of movable pusher pin pairs 14 on the insert track 12. Assuming that it is desired to change one of the insert rotors 22 and its respective gripper-jaw pairs 24 to deposit three inch wide inserts rather than six inch wide inserts, the timed drive shaft 28 is stopped which also stops movement of the pusher pin pairs 14, the timing pulley 30, the belt 32, the insert rotor pulley 34, the insert-rotor shaft 36, and the insert rotor 22. The clutch 38 is then actuated via electrical lines 66 to disengage the timing pulley 30 from the timed drive shaft 28 so that it can be rotated relative to the timed drive shaft 28. An input instruction is provided to the control system 54*a* at 56 informing the control system that the insert rotor 22 must now be synchronized to deposit three inch inserts onto the insert track 12 rather than six inch inserts. The control system 54, containing logic circuits, actuates the direct current phase-change motor 60 over lines 58 to cause rotation of the small gear 62 which, in turn, rotates the insert-rotor shaft 36 thereby rotating the insert rotor 22. Simultaneously with rotating the insert rotor 22, the phase-change motor 60 also rotates the timing pulley 30 via the belt 32, relative to the timed drive shaft 28, thereby causing a change in phase between gripper jaw pairs 24 on the insert roller 22 and pusher pin pairs 14 on the insert track 12. With this relative rotation between the timing pulley 30 and the timed drive shaft 28, the indicator brush 48 brushes over the graduated electrical impedance strip 46, thereby causing a change in impedance applied between slip rings 50***a* and *b* which is sensed by the electronic control system 54 using a voltage applied across brushes 52*a* and *b*. This impedance sensed by the control system 54 is a measurement of phase between the gripper jaw pairs 24 and the pusher pin pairs 14, thus, the control system 54 continues to activate the phase-change motor 60 until a proper phase signal is achieved indicating a proper phase for feeding three inch inserts rather than six inch inserts. Indicia 3"–6" are shown on the shaft disk 40 in FIG. 2 to indicate appropriate positions of the limit pin 44 relative to the shaft disk 40 for feeding three inch and six inch inserts as well as inserts having sizes between these two extreme sizes. It will be appreciated by those of ordinary skill in the art that sizes other than those shown in FIG. 2 could also be used in different arrangements.

While the invention has been particularly shown and described with reference to a preferred embodiment, it will be understood by those skilled in the art that various changes in form and detail may be made therein without departing from the spirit and scope of the invention. For example, the electronic sensing and indicating mechanism for sensing a phase difference could be used with a simple display readout which is used by an operator for remotely actuating the phase-change motor to achieve a desired phase relationship. That is, the phase is not automatically adjusted by a control system 54 as is depicted in FIGS. 1 and 2. In other words, the control system 54 can be quite sophisticated and automatic or can be quite simple having manually actuated switches. Also, many types of electronic measuring, or sensing, mechanisms could be used other than the brush 48 and the graduated electrical impedance strip 46. Also, measurements taken by the electronic sensing and indicating mechanism could be taken off of the shaft disk 40 and the timed drive shaft 28 by means other than slip rings. Further, during phase adjustment the insert-rotor shaft 36 could be rotated by means other than a rotational motor and it could be interconnected to the timing pulley 30 by means other than a belt.

It is extremely beneficial to have an electronic sensing and indicating mechanism for automatically sensing and signalling the phase relationship between the insert dispensing device and conveying mechanisms at the insert track, because this signal can then be used for adjusting synchronization between movements of the insert dispensing device and the insert track.

Further, it is quite beneficial to have an electronically-actuated selectively engaging and disengaging mechanism in the power train between the insert dispensing device and the insert track because in this manner the power train can be easily and remotely disengaged for adjusting the phase between the insert track and the insert dispensing device.

It is also quite helpful to have a phase-change motor which can be electrically actuated to adjust the phase relationship between the insert track and the insert dispensing device which also enables the automatic and remote adjustment of the phase.

Still another beneficial aspect of this invention is the electronic sensing and indicating mechanism mounted on selectively engageable first and second power transmitting elements in the power train for electronically sensing their positions relative to one another and providing an electronic phase-indicating signal indicative thereof. The logic control system of this invention, which interconnects the electronic sensing and indicating mechanism and the phase-change motor is extremely beneficial in that in one embodiment it automatically adjusts and monitors phases of the insert track with insert dispensing devices. In this respect, by having a logic control system an operator need only provide an input to the control system of a desired-phase relationship, which can be expressed in a size of insert, and the control system can automatically compare this with a sensed phase and control the sensed phase to achieve the desired-phase relationship.

It is beneficial that slip rings are used by the electronic sensing and indicating mechanism for transmitting a phase-relation signal to the control system because this provides an uncomplicated manner for reading electronic signals from a moving rotor.

The embodiments of the invention in which an exclusive property or privilege are claimed or defined as follows:

1. An insertion machine of a type comprising:

an elongated insert track having conveying means thereat for driving inserts along said insert track with movable driving members longitudinally spaced from one another along said track;

an insert dispensing device including an insert feeding means for sequentially engaging inserts, moving them to said insert track and disengaging them to thereby deposit them at a plurality of said longitudinally-spaced movable driving members for respectively being driven by said driving members;

a power train interconnecting said conveying means and said insert dispensing device for driving them in a predetermined phase relationship, said power train including a phase-adjustment means for adjusting said predetermined phase relationship, said phase-adjustment means including at least first and second power transmitting elements of said power train which can be selectively engaged with one another to move together or disengaged from one another to move independently of one another, an engagement means for selectively engaging and disengaging said first and second power transmitting elements, and an electronic sensing means mounted on said first and second power transmitting elements for sensing their positions relative to one another and providing an electronic phase-indication signal indicative thereof, and a phase-adjustment means coupled to said power train for acting on said power train when said first and second power transmitting elements are disengaged to achieve a desired phase-indication signal from said electronic sensing and indicating means.

2. An insertion machine as in claim 1 wherein said first and second power transmitting elements comprise a shaft and a timing pulley.

3. An insertion machine as in claim 2 wherein said electronic sensing and indicating means includes slip rings on said shaft for providing a signal from said shaft indicative of the relative positions of said first and second power transmitting elements.

4. An insertion machine as in claim 3 wherein said insert dispensing device comprises an insert rotor having insert gripper jaws thereon and said phase-adjustment means is a phase change electric motor which is remotely operable to rotate said insert rotor.

5. An insertion machine as in claim 4 wherein said phase-change motor has a shaft extending therefrom with a gear thereon which engages a gear on a shaft linked to said insert rotor.

6. An insertion machine as in claim 3 wherein a control system interconnects said electronic sensing means and said phase-adjustment means for achieving automatic phase adjustment responsive to a sensed phase adjustment.

7. An insertion machine as in claim 2 wherein is further included a control system interconnecting said electronic sensing means and said phase-adjustment means for achieving automatic phase adjustment responsive to a sensed phase adjustment.

8. An insertion machine as in claim 1 wherein said insert dispensing device comprises an insert rotor having insert gripper jaws thereon and wherein said phase-adjustment means is a phase change remotely operable electric motor coupled to said insert rotor.

9. An insertion machine as in claim 8 wherein said phase-change motor has a shaft extending therefrom with a gear thereon which engages a gear on a shaft linked to said insert rotor.

10. An insertion machine as in claim 1 wherein is further included a control system interconnecting said electronic sensing means and said phase-adjustment means for providing automatic phase adjustment responsive to a sensed phase adjustment.

11. An insertion machine as in claim 10 wherein said engagement means can be electronically and remotely actuated.

12. An insertion machine as in claim 11 wherein is further included a logic control system interconnecting said electronic sensing means and said phase-adjustment means for providing automatic phase adjustment responsive to a sensed phase adjustment.

13. An insertion machine as in claim 12 wherein said insert dispensing device comprises an insert rotor having insert gripper jaws thereon and said phase-adjustment means comprises a phase-change, remotely operable, electric motor linked to said insert rotor.

14. An insertion machine as in claim 1 wherein said engagement means can be electronically and remotely actuated.

15. A phase-adjustment apparatus for use in an insertion machine of a type comprising an elongated insert track having conveying means thereat for driving inserts along said insert track with movable driving members longitudinally spaced from one another along said track, an insert dispensing device including an insert feeding means for sequentially engaging inserts, moving them to said insert track and disengaging them to thereby deposit them at a plurality of said longitudinally-spaced movable driving members for respectively being driven by said driving members, a power train interconnected between said conveying means and said insert dispensing device for driving them in a predetermined phase relationship wherein said phase-adjustment apparatus comprises:

at least first and second power transmitting elements forming a part of said power train which can be selectively engaged with one another to move together or disengage from one another to move independently from one another, an engagement means for selectively engaging and disengaging said first and second power transmitting elements, electronic sensing means mounted on said first and second power transmitting elements for sensing their position relative to one another and providing an electronic phase-indication signal indicative thereof, a phase-adjustment means coupled to said power train for acting on said power train when said first and second power transmitting elements are disengaged to achieve a desired phase-indication signal from said electronic sensing and indicating means.

16. A phase-adjustment apparatus as in claim 15 wherein said phase-adjustment apparatus further includes a control system interconnected between said electronic sensing and indicating means and said phase adjustment means for automatically adjusting said phase relationship in response to a sensed phase relationship so as to achieve a desired phase indication signal.

17. A phase-adjustment apparatus as in claim 15 wherein said engagement means can be remotely actuated.

18. A phase-adjustment apparatus as in claim 15 wherein said phase-adjustment means is an electronic motor which can be remotely and electronically actuated.

19. A phase-adjustment apparatus as in claim 18 wherein is further included a control system interconnecting said electronic sensing and indicating means and said phase-change motor for providing automatic adjustment of said phase in order to automatically achieve a desired phase indication signal in response to a sensed phase signal.

* * * * *